US006048381A

United States Patent [19]

Kepplinger et al.

[11] Patent Number: 6,048,381

[45] Date of Patent: Apr. 11, 2000

[54] METHOD AND ARRANGEMENT FOR COOLING HOT BULK MATERIAL

[75] Inventors: Leopold Werner Kepplinger, Leonding; Gerhard Cip, Linz; Anton Himmel, Alberndorf; Karl-Heinz Zimmerbauer, Hargelsberg; Roland Sachsenhofer, Linz, all of Austria; Roy Hubert Whipp, Jr., Windermere, Fla.

[73] Assignees: Voest-Alpine Industrieanlagenbau GmbH, Linz, Austria; Brifer International Ltd., Bridgetown, Barbados

[21] Appl. No.: 08/875,303

[22] PCT Filed: Jan. 22, 1996

[86] PCT No.: PCT/AT96/00008

§ 371 Date: Oct. 15, 1997

§ 102(e) Date: Oct. 15, 1997

[87] PCT Pub. No.: WO96/23081

PCT Pub. Date: Aug. 1, 1996

[30] Foreign Application Priority Data

Jan. 23, 1995 [AT] Austria ..... A106/95

[51] Int. Cl.[7] ..... C21B 13/00

[52] U.S. Cl. ..... 75/436; 266/122; 266/178

[58] Field of Search ..... 266/122, 113, 266/168, 178; 432/85, 77; 75/436

[56] References Cited

U.S. PATENT DOCUMENTS

| | | | |
|---|---|---|---|
| 3,831,911 | 8/1974 | Dorville | 266/122 |
| 4,290,801 | 9/1981 | Kryczun et al. . | |

FOREIGN PATENT DOCUMENTS

| | | |
|---|---|---|
| 358617 | 9/1980 | Australia . |
| 1215666 | 4/1960 | France . |
| 1315257 | 4/1963 | France . |
| 25668 | 7/1963 | Germany . |
| 2625223 | 12/1976 | Germany . |
| 2928501 | 1/1980 | Germany . |
| 2935707 | 3/1980 | Germany . |
| 56-163209 | 12/1981 | Japan . |
| 59-170213 | 9/1984 | Japan . |
| 63-7341 | 1/1988 | Japan . |
| 6-316718 | 11/1994 | Japan . |
| 654652 | 2/1986 | Switzerland . |
| 755844 | 8/1980 | U.S.S.R. . |
| 1438852 | 6/1976 | United Kingdom . |

*Primary Examiner*—Scott Kastler
*Attorney, Agent, or Firm*—Ostrolenk, Faber, Gerb & Soffen, LLP

[57] ABSTRACT

In order to attain as low a final temperature as possible after as short a period of time as possible in a method of cooling hot briquetted sponge iron (3) under optimum utilization of the cooling medium, the hot briquetted sponge iron (3), in a first cooling step (11), is passed exclusively by a gaseous cooling medium while being gently cooled and subsequently, in a second cooling step (14), is sprayed with a liquid cooling medium, thus being intensively cooled to the final temperature desired.

20 Claims, 1 Drawing Sheet

I
II
III
$T_A$
$T_1$
$T_E'$
$T_E''$
$T_E$
l
1
2
3
4
5
6
7
8
9
10
11
12
13
14
15
16
17
18

METHOD AND ARRANGEMENT FOR COOLING HOT BULK MATERIAL

BACKGROUND OF THE INVENTION

1. Field of the Invention

The invention relates to a method of cooling hot briquetted sponge iron as well as an arrangement for carrying out the method.

2. Description of the Related Art

For the safe and economically justifiable transportation and storage of hot briquetted sponge iron, the latter must be subjected to cooling following upon the production of the sponge iron as immediately as possible.

To cool hot burnt material, for instance, sinters or pellets, it is known (AT-B358.617) to conduct the hot material through a shaft cooler and to direct cooling air through the shaft cooler in counterflow. To efficiently cool the material down to the final temperature desired, for instance ranging between 70 and 80° C., it is necessary to press a large amount of cooling air through the shaft cooler, to which end a high energy input is necessary. Furthermore, the high air speeds involved give rise to an increased discharge of material along with the cooling air emerging from the shaft cooler, in particular, if the grain size of the material is only very small.

From DE-C-29 35 707 it is known to cool hot briquetted sponge iron by introducing the same into a quenching tank, in which it is cooled to the final temperature desired. DE-C-29 35 707, furthermore, mentions that the quenching tank also may be replaced with an air cooling.

From DE-C-29 28 501 and DE-C-26 25 223 it is, furthermore, known to conduct hot briquetted sponge iron through a quenching tank by aid of a conveying belt, the sponge iron briquets incurring at a temperature of between 550 and 700° C. being cooled to approximately 80 to 90° C. After delivery of the sponge iron briquets from the quenching tank, the sponge iron briquets dry up by the residual heat present within the same.

Such known water cooling by immersion involves the disadvantage that the mechanical parts destined for the transport of the hot sponge iron briquets alternately get into contact with hot water having high contents of solids, $CO_2$ and suspended matter and with ambient air such that these parts are subject to intensive wear. Due to the very hot sponge iron briquets contacting cooling water, water gas reactions are likely to occur. Moreover, water cooling is poorly efficient due to the Leidenfrost phenomenon, which occurs very intensively in such a high temperature range. The insulating layer thus formed of water vapor on the surface of the sponge iron briquets has strongly adverse effects on the heat transfer in the high temperature range. In addition, the quality of the product will be deteriorated due to the still hot sponge iron briquets getting into contact with the cooling water, namely by material chipping off the sponge iron briquets. As a result, a very large amount of fine material incurs, which is detrimental to the functioning of mechanically moved parts of the conveying installations, etc., and frequently likewise is undesired in the further processing of the sponge iron briquets, in particular, in the further processing of sponge iron briquets.

From DE-C-29 28 501 it is, furthermore, known to charge a briquet strip onto a conveyor and spray the same with liquid, the briquet strip thus being cooled to a temperature ranging from 250 to 350° C. This, again, involves the above-described disadvantages, i.e., water gas reactions, the occurrence of the Leidenfrost phenomenon and hence non-uniform and insufficient cooling as well as thermal stresses and hence chipping off.

The briquetted sponge iron is to exhibit a high product quality, the formation of fine particles during cooling being avoided as far as possible. The arrangement for carrying out the method is to be subject to slight wear, thus having a long service life.

SUMMARY OF THE INVENTION

The invention overcomes the disadvantages of the prior art, such as those noted above, by providing methods and apparatus of cooling hot briquetted sponge iron which enable the troublefree progression of cooling at the optimum utilization of the capacity of the cooling means.

In accordance with the invention, this object is achieved by the combination of the following characteristic features:

- the hot briquetted sponge iron, in a first cooling step, is passed exclusively by a gaseous cooling medium, preferably cooling air, while being gently cooled,
- whereupon, in a second cooling step, the briquetted sponge iron is sprayed with a liquid cooling medium, preferably cooling water, thus being intensively cooled to the final temperature desired.

In doing so, the briquetted sponge iron, preferably during the second cooling step, additionally is passed by a gaseous cooling medium so as to provide for a particularly intensive contact between the sponge iron and the cooling medium.

Suitably, the hot briquetted sponge iron, during the first cooling step, is cooled to a temperature amounting to at least half the temperature of the hot briquetted sponge iron, preferably to a temperature below this temperature, which renders the use of the liquid cooling medium particularly efficient, primarily because the intensity at which the Leidenfrost phenomen occurs as well as its insulating effect are substantially slighter at lower temperatures than at high temperatures.

Preferably, the first cooling step is carried out over a longer period of time than the second cooling step, preferably over a period of time of more than 60% of the overall cooling time.

In order to ensure a particularly good contact between the gaseous cooling medium and the sponge iron, feeding of gaseous cooling medium, according to a preferred embodiment, is effected by pressing or sucking, the sponge iron being deposited on a gas-permeable support in the form of a bed.

A preferred mode of feeding liquid cooling medium to the briquetted sponge iron is realized by injecting liquid cooling medium into an air flow through nozzles. Again, it is feasible to largely avoid an insulating effect caused by water vapor forming on the surface of the sponge iron.

In order to reduce the load of dust on the cooling air and to save the arrangement, dust collection by exhaust ventilation advantageously is carried out prior to the first cooling step.

An arrangement for carrying out the method is characterized by the combination of the following characteristic features:

- a gas-permeable support for the briquetted sponge iron, by which the sponge iron is capable of being moved through the arrangement,
- a gas conduction means at least partially surrounding the support and destined for supplying a gaseous cooling medium to the briquetted sponge iron,
- spraying nozzles for spraying a liquid cooling medium on the briquetted sponge iron, the spraying nozzles being arranged only in the second half—viewed in the direction of movement of the support entraining the sponge iron—of the arrangement.

A preferred embodiment of the arrangement is characterized in that the support is comprised of a continuous conveying belt, such as a plate belt, whose upper belt side serves to receive the hot briquetted sponge iron.

Another preferred embodiment comprises a grating designed as a rotary cooler as the support for the sponge iron.

Preferably, the gas conduction means also extends over the area of the spraying nozzles.

Suitably, the support receiving the sponge iron passes through a dust extraction means after charging of the sponge iron and before entry into the gas conduction means.

To apply the liquid cooling medium, either mono-component or two-component nozzles are provided, both liquid cooling medium and gaseous cooling medium being feedable to the briquetted sponge iron via the latter.

BRIEF DESCRIPTION OF THE DRAWINGS

In the following, the invention will be explained in more detail by way of the drawing, wherein.

DETAILED DESCRIPTION OF THE PREFERRED EMBODIMENTS

Figures 1, 2, 3:
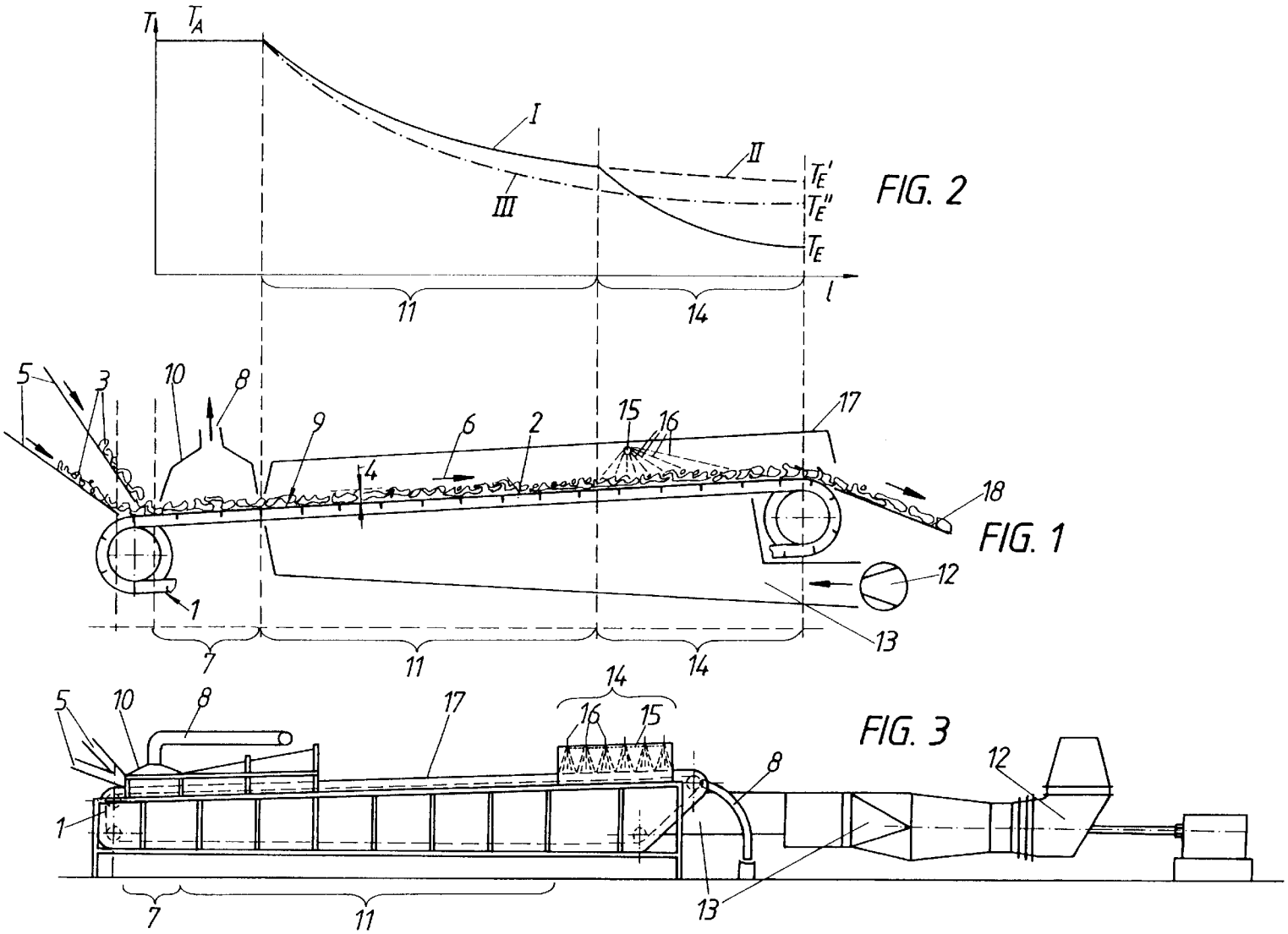
FIG. 1 schematically illustrates a cooling arrangement according to the invention in the side view and FIG. 2 illustrates the principal temperature course adjusting over the length of the cooling path
FIG. 3 shows the structural configuration of a cooling arrangement according to the invention, also in the side view.

According to the embodiment represented in the drawing, FIG. 1, the cooling arrangement is equipped with a continuously and uniformly driven continuous conveying belt 1, such as a plate belt, whose upper belt side 2 serves as a support for hot sponge iron briquets 3. This sponge iron 3 is charged onto the gas-permeable continuous conveying belt 1 suitably in strip form, e.g., at a layer height 4 of about 200 mm and at a width corresponding to the belt width, such as, e.g., approximately 1000 mm. Charging of the sponge iron 3 is effected through charging chutes 5 in several layers so as to form a sponge iron strip 9 as uniform as possible.

When moving the sponge iron 3 in the direction of arrow 6 by entrainment with the continuous conveying belt 1, the sponge iron, at first, is guided through a dedusting zone 7, which comprises a hood 10 connected to a dust exhaust ventilation 8 and covering the sponge iron strip 9. In the dedusting zone, the fine material adhering to the surfaces of the sponge iron particles, such as, e.g., on the surfaces of the briquets, is removed by suction.

After this, the sponge iron strip 9 is moved through an air cooling zone 11, in which the hot sponge iron 3—which has a temperature $T_A$ ranging between 580 and 720° C. when being deposited on the continuous conveying belt 1—is cooled to about 350° C. exclusively by aid of cooling air, according to FIG. 1 by aid of cooling air pressed through the sponge iron strip 9 from below. The cooling air is compressed by means of a compressor 12 and is supplied to the upper belt side 2 via an air conduction means 13 in a manner that the air is forced to flow through the sponge iron strip 9.

The cooling air system comprises a sound absorber, a volume flow control means as well as collecting and distributing channels not illustrated in detail, including the necessary shut-off devices and control means.

In the approximately third third of the upper belt side 2 a water cooling zone 14 is provided, in which the sponge iron 3 is intensively cooled to a surface temperature of approximately 85° C. by means of sprayed-on water. Water spraying is effected via a distribution system 15 through several spraying nozzles 16, which are designed either as one-component nozzles or as two-component nozzles. If two-component nozzles are employed, these are fed with treated water and compressed air.

According to the embodiment illustrated in FIG. 1, the air supply also extends over the water cooling zone 14 such that an additional cooling effect by cooling air is achieved in the water cooling zone 14.

The air pressed through the hot sponge iron 3 and the vapor forming are collected in an exhaust hood 17 and are carried off via an exhaust ventilation including a purification means not illustrated in detail.

After the sponge iron 3 has left the continuous conveying belt 1 and is conveyed further via a discharge chute 18, drying of the sponge iron 3 is effected by the residual heat still contained within the same.

From FIG. 2, the particularly high efficiency of the cooling method according to the invention is clearly apparent. The temperature course on the surface of the sponge iron 3 over the length of the cooling arrangement is indicated by full, uninterrupted line I. It can be seen that the sponge iron 3 undergoes gentle and careful cooling in the air cooling zone 11, in which cooling is effected exclusively by air. It is only when the sponge iron 3, by exclusive air cooling, has reached a temperature amounting to approximately half of the initial temperature $T_A$ or less that the invention provides for water cooling, which causes relatively harsh and intensive cooling of the sponge iron 3 as compared to air cooling. The final temperature of the sponge iron 3 thereby reached after a relatively short cooling period is denoted by $T_E$.

The temperature course of the sponge iron 3 that would occur with exclusive air cooling over the total length of the upper belt side 2 is illustrated in FIG. 2 by broken line II. The final temperature $T'_E$ of the sponge iron attained in that case clearly lies above the final temperature $T_E$ attained according to the invention. In order to be able to attain the final temperature $T_E$ according to the invention exclusively by air cooling, the arrangement would have to extend over a substantially greater length and/or the air flow rate would have to be substantially increased in terms of quantity and the layer height 4 of the sponge iron strip 9 and hence the specific flow rate would have to be reduced.

A cooling curve that would result from cooling of the sponge iron 3 if the sponge iron 3 in an initial zone were sprayed exclusively with liquid cooling medium, i.e., cooling water, is illustrated in FIG. 2 by dot-and-dash line III. It will be appreciated that, at first, harsher cooling occurs than with air, but that, due to the occurrence of the Leidenfrost phenomenon to an increased extent, the effectiveness of cooling cannot come up to that of the cooling effect according to the invention, i.e., the final temperature $T''_E$ attainable exclusively by means of liquid cooling medium likewise lies above the final temperature $T_E$ attained according to the invention; thus, the cooling arrangement would have to be designed longer and the sponge iron would have to be exposed to cooling medium over a longer period of time also in that case.

In addition, there is the danger of water gas reactions forming and of product qualities deteriorating, because harsh cooling in the high temperature range $T_A$ with sponge iron may lead to chipping off and hence to the formation of fine portions in inadmissible amounts.

The invention is not limited to the exemplary embodiment illustrated in the drawing, but may be modified in various aspects. It is, for instance, possible to replace the continuous conveying belt 1 with a rotary cooler comprised of a gas-permeable grate and rotating slowly, wherein the sponge iron deposited on the grate, during a rotation of the grate, for instance by 260°, is cooled by means of cooling air and subsequently by means of cooling water. Furthermore, it is also possible to realize air cooling merely in the air cooling zone 11 and to operate exclusively with one-component or two-component nozzles in the consecutively arranged water cooling zone 14. The cooling air may be directed through the sponge iron belt 9 from bottom or from top by suction or pressing.

We claim:

1. A method of cooling hot briquetted sponge iron, comprising the steps of:

depositing briquetted sponge iron at a temperature ($T_A$) in strip form in several layers, cooling the briquetted sponge iron, in a first cooling step, exclusively by a gaseous cooling medium, the briquetted sponge iron being gently cooled, further cooling the briquetted sponge iron, in a final cooling step, the briquetted sponge iron being sprayed with a liquid cooling medium, and thus being intensively cooled to the desired final temperature ($T_E$) under the exclusion of immersion cooling;

wherein the briquetted sponge iron, during the first cooling step, is cooled to a temperature amounting to at least half the temperature ($T_A$) of the briquetted sponge iron.

2. A method according to claim 1, wherein the briquetted sponge iron, during the second cooling step, additionally is passed by a gaseous cooling medium.

3. A method according to claim 1, wherein the first cooling step is carried out over a longer period of time than the second cooling step, preferably over a period of time of more than 60% of the overall cooling time.

4. A method according to claim 1, wherein feeding of gaseous cooling medium is effected by pressing or by suction.

5. A method according to claim 2, wherein feeding of liquid cooling medium is effected by injecting said liquid cooling medium into an air flow through nozzles.

6. A method according to claim 1, wherein dust collection by exhaust ventilation is carried out prior to the first cooling step.

7. An arrangement for carrying out the method according to claim 1, the arrangement having only two cooling zones and comprising:

a gas-permeable support for the briquetted sponge iron, by which the sponge iron is capable of being moved through the arrangement, a gas conduction means at least partially surrounding the support and destined for supplying a gaseous cooling medium to the sponge iron in a first cooling zone, spraying nozzles for spraying a liquid cooling medium on the sponge iron in a second cooling zone, the spraying nozzles being arranged only in the second half-viewed in the direction of movement of the support entraining the sponge iron—of the arrangement constructed without an immersion cooling device.

8. An arrangement according to claim 7, wherein the support is comprised of a continuous conveying belt, whose upper belt side serves to receive the hot briquetted sponge iron.

9. An arrangement according to claim 7, wherein the support is comprised of a grating designed as a rotary cooler.

10. An arrangement according to claim 7, wherein the gas conduction means also extends over the area of the spraying nozzles.

11. An arrangement according to claim 7, wherein the support receiving the sponge iron (3) passes through a dust extraction means after charging of the sponge iron and before entry into the gas conduction means.

12. An arrangement according to claim 7, wherein mono-component nozzles are provided for applying said liquid cooling medium.

13. An arrangement according to claim 7, wherein two component nozzles are provided for applying said liquid cooling medium, through which both liquid cooling medium and gaseous cooling medium are feedable to the sponge iron.

14. A method according to claim 1, wherein the first cooling step is performed so as to substantially avoid an insulating effect caused by water vapor forming on the surface of the sponge iron in the second cooling step.

15. A method according to claim 1, wherein the hot briquetted sponge iron is disposed in strip form in several layers at a height of roughly 200 mm.

16. A method according to claim 1, wherein the gaseous cooling medium is cooling air and the liquid cooling medium comprises water.

17. A method according to claim 1, wherein the briquetted sponge iron undergoes drying after the second cooling step by residual heat.

18. An arrangement according to claim 8, wherein the support comprises a plate belt.

19. An arrangement according to claim 7, further comprising a discharge chute in which the sponge iron undergoes drying as a result of residual heat after the sponge iron leaves the support.

20. A method of cooling hot briquetted sponge iron, comprising the steps of:

charging briquetted sponge iron at a temperature ($T_A$) from a plurality of charging chutes onto a conveyor, the briquetted sponge iron being charged in strip form in several layers;

removing dust from the briquetted sponge iron;

cooling the briquetted sponge iron, in a first cooling zone, exclusively by a gaseous cooling medium, the briquetted sponge iron being gently cooled to a temperature at least half of ($T_A$);

further cooling the briquetted sponge iron, in a final cooling zone, the briquetted sponge iron being sprayed with a liquid cooling medium, and thus being intensively cooled to the desired final temperature ($T_E$) under the exclusion of immersion cooling;

wherein a length of the final cooling zone is about half that of the first cooling zone.

* * * * *